US006655557B2

(12) United States Patent
Rousselet et al.

(10) Patent No.: US 6,655,557 B2
(45) Date of Patent: Dec. 2, 2003

(54) DISPENSING DEVICE AND METHOD

(75) Inventors: Guilhem Rousselet, Paris (FR); Nicolas Albisetti, Clichy (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 09/960,655

(22) Filed: Sep. 24, 2001

(65) Prior Publication Data

US 2002/0036214 A1 Mar. 28, 2002

(30) Foreign Application Priority Data

Sep. 22, 2000 (FR) ..... 00 12099

(51) Int. Cl.[7] ..... B67D 5/42

(52) U.S. Cl. ..... 222/391; 222/390; 222/386; 222/405

(58) Field of Search ..... 222/405, 390, 222/386, 391

(56) References Cited

U.S. PATENT DOCUMENTS

| | | | | |
|---|---|---|---|---|
| 1,055,028 A | * | 3/1913 | Payne | 222/390 |
| 2,568,856 A | * | 9/1951 | Hartmann | 222/390 |
| 2,627,365 A | * | 2/1953 | Gabler | 222/326 |
| 2,635,789 A | * | 4/1953 | Gabler | 222/327 |
| 2,763,405 A | * | 9/1956 | Shvetz | 222/320 |
| 3,059,820 A | | 10/1962 | Gabler | |
| 3,241,729 A | * | 3/1966 | Gabler | 222/390 |
| 5,037,010 A | * | 8/1991 | Dikstein | 222/390 |
| 5,133,474 A | * | 7/1992 | Smith et al. | 220/529 |
| 5,992,705 A | * | 11/1999 | Lhuisset | 222/386 |

FOREIGN PATENT DOCUMENTS

| | | | | |
|---|---|---|---|---|
| DE | 87 00 756 | | 5/1987 | |
| FR | 1 384 417 | | 11/1964 | |
| FR | 2 602 753 | | 2/1988 | |
| GB | 157 699 | | 1/1921 | |
| GB | 385 182 | | 12/1932 | |
| GB | 468 029 | | 6/1937 | |
| GB | 524811 | * | 2/1940 | |
| GB | 524 811 | | 8/1940 | |
| GB | 2193944 A | * | 2/1988 | B65D/25/38 |
| GB | 2241022 A | * | 8/1991 | B65D/83/76 |
| GB | WO-94/18092 | * | 8/1994 | B65D/83/00 |

OTHER PUBLICATIONS

English language Derwent Abstract of FR 2 602 753, Feb. 19, 1988.

* cited by examiner

*Primary Examiner*—Michael Mar
*Assistant Examiner*—F Nicolas
(74) *Attorney, Agent, or Firm*—Finnegan Henderson Farabow Garrett & Dunner, L.L.P.

(57) ABSTRACT

A dispensing device is provided for dispensing a product that may be of viscous consistency, such as, for example, a cream or a gel. The dispensing device includes a container having a first end closed by a bottom and a second end that has an opening. A dispensing element is configured to be arranged on the product and forms a passage comprising at least one inlet orifice extending in a plane not perpendicular to an axis of the device, and an outlet orifice formed at least partly some distance from the inlet orifice. The outlet orifice extends at least partially above the inlet orifice. Rotating the dispensing element on the product causes the product to be delivered through the outlet orifice.

61 Claims, 7 Drawing Sheets

DISPENSING DEVICE AND METHOD

The present invention relates to a dispensing device for packaging and dispensing products, for example, of viscous consistency, such as a cream, a paste, an ointment, a balm or a gel. The invention may be used in the packaging and dispensing of products for cosmetic, dermatological or medical use, such as care creams.

In the sphere of cosmetics and skin care, a pot, or shallow container, has been, and continues to be, widely used. Included amongst the cosmetic products that are packaged in such pots are creams, such as thinning creams, or such as those used for skin care. A dispensing device, such as the pot is suited to the packaging of these products in that it allows easy access to the product it contains, particularly when the product needs to be picked up directly on the fingers. Furthermore, because of the wide opening which characterizes it, it is possible to empty it completely, something that is desirable, for example, in the case of products that are sold to the consumer at a relatively high cost per unit weight.

One of the problems that arises for such a method of packaging and dispensing relates to the protection of its contents, for example, from ambient that could deteriorate the product. Another problem relates to the "contamination" of the product caused by picking up the product with the fingers. To solve the latter problem, it has been proposed for the product to be picked up on a spatula. This method of picking-up does not, however, play any part in protecting the contents from external contamination or from contact with the air. It is also known practice for the product to be protected by means of a disc that covers the free surface of the product, wherein such a disc has at least one opening arranged in a plane parallel to the plane of the disc, and the opening(s) are more or less at right angles to the axis of the pot. A device such as this is known, in particular, from FR-A-2 602 753 or from FR-A-1 384 417. In general the product is dispensed by pushing the disc down inside the pot, either simply by sliding or by turning, via a screw thread formed on the interior wall of the pot, wherein the screw thread is capable of collaborating with a corresponding screw thread formed by the periphery of the disc. As a result of the raised pressure exerted inside the pot, the product creeps and is delivered through an opening of the disc. This creep movement, however, may be detrimental to the product, particularly to its cosmetic or dermatological qualities. This is because by pressurizing the product in this way its viscosity may be modified to the point that its characteristics of application, for example, the smoothness, freshness and penetration into the skin, or its behavior are modified. Furthermore, experience teaches that metering out the amount of product picked up is not exactly precise, because of the inherent inertia in such a dispensing system. Finally, depending on the viscosity of the product, the force to be exerted to cause the product to creep may be prohibitive in terms of use.

British Patent No. 0006332 teaches the use of a dispensing element that, on the one hand, acts as a lid, and on the other hand, has an opening delimited by a lip cut in the disc formed by the dispensing element and bent towards the bottom of the pot. Thus, in combination with the disc, the lip delimits a first "opening", the upper edge of which is in the plane of the disc, and the lower edge of which coincides with the free edge of the bent back lip. By turning the disc inside the pot, the product is forced to travel via this first opening, up along the folded back lip and to be delivered directly onto the surface of the disc via a second opening, a first edge of which coincides with the upper edge of the first opening, and of which a second edge, opposite the first, coincides with the axis of folding of the lip. The second opening is thus in the plane of the disc, that is to say in the plane of the upper edge of the first opening. The disc is turned by means of two handles arranged diametrically opposite each other on the upper surface of the disc.

A similar configuration is described in GB-A-0 385 182.

A major disadvantage with the configuration described in these above-mentioned documents stems from the fact that the product is delivered directly onto the surface of the disc and then has to be picked up, particularly with a finger, once the disc has been turned through a sufficient angle to deliver the necessary amount of product. Experience teaches that it is difficult to pick up all of the product lying on the surface of the disc. The latter therefore remains sullied. A result such as this is completely incompatible with hygiene and cleanliness requirements associated with the packaging and handling of products, such as, for example, cosmetic products.

Problems of the same kind arise with the configurations described in GB-A-0 524 811 and GB-A-0 157 699. Furthermore, as the disc is simply placed on the free surface of the product, the product has to have sufficient consistency. If it does not, there is a risk that the disc will sink inadvertently into the pot in response to the pressure inevitably exerted when turning the disc. There is then the risk of product being delivered onto the upper surface of the disc, not only through the opening formed by the bent back lip, but also, all around the disc. Furthermore, because of such a configuration, accurate metering out of the amount dispensed is extremely difficult to achieve.

Hence, one of the optional aspects of the present invention is to provide a dispensing device equipped with a dispensing element that fully or partially solves one or more of the problems mentioned with reference to conventional devices.

In particular, one optional aspect of the present invention is to provide a dispensing device that, in an easy-to-use and hygienic manner, allows the picking-up of almost all of the product that has been forced to pass onto the top of the dispensing element.

Another optional aspect of the present invention is to provide a dispenser that makes it possible, in a single action and simultaneously, to deliver the product and to allow it to be picked up by an applicator member, such as a finger.

Yet another optional aspect of the invention is to provide a dispensing device for packaging and dispensing a product, such as, for example, a cosmetic product, and which affords the product protection against external "contamination" or the ambient air, without appreciably affecting its characteristics, like its rheological characteristics.

Yet another optional aspect of the invention is to provide a dispensing device that allows precise metering out of the product that is to be dispensed.

Yet another optional aspect of the invention is to provide a system that is economical to produce, simple to use, and reliable.

Even further optional aspects will become apparent in the light of the description, which follows.

One aspect of the invention includes a dispensing device for a product of viscous consistency, such as, for example, a cream or a gel. The dispensing device includes a container, such as a pot, having an axis X, a first end enclosed by a bottom and a second end having an opening. Arranged on the product is a dispensing element forming a passage comprising at least one inlet orifice extending in a plane not perpendicular to the axis X, and an outlet orifice formed at least partly some distance from the inlet orifice, wherein said outlet orifice extends at least partially above an upper edge of the inlet orifice, and wherein turning the dispensing element on the product causes the product to be delivered through the outlet orifice.

The outlet orifice may extend at an angular distance from the inlet orifice. Such an angular distance may be on the order of 25° to 90°, for example about 45°.

By raising the outlet orifice with respect to the inlet orifice, it may be possible to deliver the product some distance from the surface of the dispensing element. This could make it easier to pick up the product directly without the product being deposited on the upper surface of the dispensing element. As a result of this, the outer surface of the dispensing element may be clean.

Optionally, at least a part of the edge delimiting the outlet orifice may be used as a means with which the applicator member, for example one of the fingers of the user, can be engaged in order to turn the dispensing element inside the dispensing device. Depending on the configuration of the outlet orifice, it may be possible to allow the applicator member to engage with the dispensing element in such a way that the dispensing element can be turned by means such as a finger, and at the same time the delivered product can be collected directly on the finger.

The device could be configured so that, rotating the dispensing element "slices" the product by the edge of the inlet orifice closest to the bottom of the dispensing device. Such an edge could act in the manner of a rotary blade on the surface of the product. With such an exemplary arrangement, it may be possible to avoid the "creep" mentioned hereinabove with reference to certain conventional devices. In addition, certain exemplary embodiments might provide dispensing without altering the product characteristics, such as, for example, rheological characteristics.

In one aspect, the dispensing element could be mounted removably on the dispenser, which offers even more flexibility in use.

According to another aspect of the invention, the dispenser comprises means for causing, in response to relative rotation between the product and the dispensing element, a reduction in an axial distance between the dispensing element and the bottom of the dispensing device. This could allow the sinking of the dispensing element inside the dispensing device to be controlled more precisely, independent of the axial pressure exerted on it, for example with the finger. The amount of product dispensed may be metered precisely, for example.

In an optional aspect, the dispensing element comprises a rim having one edge at least partially delimiting the outlet orifice, wherein the rim allows a user to turn the dispensing element inside the dispensing device by applying a force to the rim. By engaging her finger with the rim, the user can turn the dispensing element. Because of the position of the finger or of any other applicator member (for example a spatula) with respect to the outlet orifice during the turning, the product could be delivered directly onto the finger. Pick-up could be automatic. Thereafter, the product could be applied to the desired spot.

The height of the rim may be from about 1 mm to about 15 mm, such as, for example from about 2 mm to about 5 mm.

In another optional aspect, at least part of the outlet orifice extends in a plane that is not parallel to the plane of the inlet orifice. A configuration such as this could make it easier for the product being delivered to be deposited on the finger or applicator member that is turning the dispensing element.

According to exemplary arrangements, this transfer of product directly onto the applicator member could be further improved when, in addition, a part of the outlet orifice extends in a plane more or less parallel to the plane of the inlet orifice.

As another optional aspect, a cross section of the outlet orifice may be greater than or equal to a cross section of the inlet orifice. A cross section of the outlet orifice may also be of a different shape than a cross section of the inlet orifice. Such an arrangement could allow the turning of the disc not to be slowed by the dispensing of the product through the outlet orifice.

In one optional aspect, a mean radial width of the inlet orifice is greater than a mean radial width of the outlet orifice.

According to one optional aspect, the dispensing element has a transverse cross section, having substantially the same shape as a transverse cross section of an interior of the dispensing device, with the interior defining a reservoir for containing product. The inlet orifice extends radially from a first end situated near the center of the dispensing element to a second end situated near the periphery of the dispensing element (e.g. at the periphery or close to it). This might allow the product to be protected as much as possible. Furthermore, substantially an entirety of the cross section of the dispensing device could be swept by the inlet orifice when the inlet orifice is turned in the dispensing device. As a result of this, a height of the product could decrease uniformly across the entire cross section of the dispensing device.

The radial width of the outlet orifice could be less than or equal to the width of a finger (or of any other applicator member). In an exemplary embodiment this width could be 20 mm or less, so that all of the delivered product can be deposited directly on the finger. For example, such a radial width may be from about 5 mm to about 10 mm.

According to another optional aspect of the invention, the dispensing element could be configured in the form of a flat element of circular cross section, at least partially forming a portion of a helix. Optionally, the flat element forms a portion of a helix over an angle of approximately 360°.

Beyond the more or less helical portion, the dispensing element could be continued by the passage through which the product is forced out. A passage such as this may extend over an angle of about 45°. In one optional aspect, the passage has a bottom extending between the inlet orifice and the outlet orifice, wherein the mean slope of the bottom is greater than the mean slope of the helix portion. As a result, it may be possible to have the lower edge of the outlet orifice some distance from the surface of the dispensing element. As discussed previously, a configuration such as this, in which one edge of the outlet orifice is raised, could allow the user to engage an applicator member, for example, a finger, between the surface of the flat element and the edge of the outlet orifice so as to turn the dispensing element, the product being delivered through the outlet orifice then being deposited directly on the applicator member.

If the dispensing element is at least partly of helical form, the peripheral edge of the dispensing element can be engaged with a corresponding screw thread formed on the interior surface of the dispensing device. The collaboration of the screw thread of the interior wall of the dispensing device with the screw thread formed by the peripheral edge of the dispensing element could make it possible to provide a good seal at this point, and to exclude any delivery of product other than via the outlet formed by the at least one opening formed in the dispensing element. The screw thread can be obtained by molding on the internal wall of the dispensing device, or may alternatively be formed on an added-on element that is to be inserted inside a smooth-walled dispensing device, as well as other ways of forming screw threads known to those in the art.

In another optional aspect, the screw thread formed inside the dispensing device comprises recessed portions whose axial height exceeds the thickness of the peripheral edge of the dispensing member. Means may be provided, particularly in the form of a continuous or discontinuous lateral rim, which are formed by the dispensing element and are capable of forcing the dispensing element into engagement with the uppermost part of the recessed portions. The greater height of the recessed portions of the screw thread makes it possible, for example, when using a finger, to be able to collect the product that may have been deposited thereon during use of the dispenser. Such collection would be difficult to achieve if the height of the recessed portions of the screw thread were more or less equal to the thickness of the dispensing element. This thickness may be on the order of about 0.5 to about 2 mm.

According to another optional aspect, the dispensing element comprises a central passage having an interior wall provided with a screw thread capable of engaging with a corresponding screw thread provided on a threaded rod mounted fixedly in the dispensing device and extending axially from the bottom of the dispensing device to near the opening of the dispensing device.

In one optional aspect, the plane of the inlet orifice passes more or less through the axis X of the container. The edge of the inlet orifice closest to the bottom of the dispensing device may be straight or curved, such as, for example, for reasons of easing mould release.

The bottom of the dispensing device may have a profile similar to the profile of the dispensing element so as to allow practically the entire contents of the dispensing device to be used up. In any event, the dispensing element may be mounted removably on the dispensing device so that, at the end of use, it can be removed so that the dispensing device can be completely emptied.

The bottom of the dispensing device may comprise an added-on bottom. Such a bottom may be snap-fastened, screwed, bonded, welded on, or affixed by any other means known to those of skill in the art. Alternatively, the bottom may form a single piece with the container. The various constituent parts of the dispensing device may be formed of a thermoplastic, such as, for example, a polyethylene, a polypropylene, a polyethylene terephthalate, or a polyvinyl chloride, or of a material from the styrene family.

In another optional aspect of the invention, for example, in the case of air-sensitive products, such as a good many cosmetic products or care products, or in the case of products of thinner consistency, the opening of the dispensing device may be closed off by a removable closure element, such as, for example, a conventional lid.

The dispensing device according to the invention can be used, for example, in packaging and dispensing a viscous product. For example, the product could be a cosmetic product or medical product. Examples of types of products include a cream, an ointment, a balm, or a gel.

According to another aspect of the invention, the dispensing device comprises a container defining a reservoir configured to contain a product. The container has a bottom, an opening, and an axis. A dispensing element configured to be in contact with product in the reservoir is also provided. The dispensing element defines a passage comprising at least one inlet orifice extending in a plane not perpendicular to the axis of the container and at least one outlet orifice spaced at least partially from the inlet orifice and extending at least partially above an upper edge of the inlet orifice. The dispensing element is also configured to rotate relative to the container so as to cause the product to be delivered through the outlet orifice.

Optionally, the dispensing device may further comprise means for causing a reduction in an axial distance between the dispensing element and the bottom when the dispensing element is rotated relative to the container.

According to another optional aspect of the invention, the dispensing device comprises a container defining a reservoir configured to contain a product. The container has a bottom and an opening. Also provided is a dispensing element configured to be in contact with product in the reservoir. The dispensing element defines a passage comprising at least one inlet orifice and at least one outlet orifice spaced from the inlet orifice. The dispensing element is further configured to rotate relative to the container about an axis of rotation so as to cause the product to be delivered through the outlet orifice. Additionally, the inlet orifice and the outlet orifice are positioned at differing radial positions with respect to the axis of rotation.

In another optional aspect of the invention, the dispensing device comprises a container defining a reservoir configured to contain a product, the container having a bottom, an opening, and an axis, and an interior portion of the container includes screw threading. Also provided is a dispensing element configured to be in contact with product in the reservoir. The dispensing element defines a passage comprising at least one inlet orifice extending in a plane not perpendicular to the axis and at least one outlet orifice spaced at least partially from the inlet orifice. The dispensing element is also configured to rotate relative to the container so as to cause the product to be delivered through the outlet orifice. In addition, a peripheral edge of the dispensing element forms a portion configured to be engaged with the screw threading formed on the interior portion of the container.

According to yet another optional aspect of the invention, the dispensing device comprises a container defining a reservoir configured to contain a product. The container has a bottom, an opening, an axis, and a rod mounted inside the container. The rod extends from the bottom to near the opening and an exterior surface of the rod includes screw threading. Also provided is a dispensing element configured to be in contact with product in the reservoir. The dispensing element defines a passage comprising at least one inlet orifice extending in a plane not perpendicular to the axis and at least one outlet orifice spaced at least partially from the inlet orifice. The dispensing element further defines a central passage having an interior surface including screw threading configured to be engaged with the screw threading provided on the exterior surface of the rod. The dispensing element is configured to rotate relative to the container so as to cause the product to be delivered through the outlet orifice.

In another aspect of the invention, the dispensing device comprises a container defining a reservoir configured to contain a product, the container having a bottom and an opening. Also provided is a dispensing element configured to be in contact with product in the reservoir. The dispensing element defines a passage comprising at least one inlet orifice and at least one outlet orifice spaced from the inlet orifice. The dispensing element is configured to rotate relative to the container about an axis of rotation so as to cause the product to be delivered through the outlet orifice. The passage at least partially encircles the axis of rotation.

As used herein, "at least partially encircle" the rotational axis includes substantially circular passages, passages having substantially the shape of portions of circles (e.g. arcs), and other substantially curved passages either partially surrounding or completely surrounding the axis of rotation. For example, the passage might extend an angle of about 10° to about 360° with respect to the axis or about 25° to about 90°. The use of the term encircles is not to be construed to limit the path of the passage to one of only circular shape. The passage may be of any shape that allows it to partially surround the axis in this sense.

According to another aspect of the invention, a method of using the dispensing device is provided comprising providing a dispensing device as in any of the hereinbefore-described aspects. Rotating the dispensing element relative to the container to thereby dispense product through the outlet orifice, and applying the product to a surface. The dispensing element may be, for example, one or more fingers or another device such as a spatula. The product could be dispensed directly from the outlet orifice onto the applicator member. In addition, the surface to which the product is applied may be an external body portion, such as skin and/or hair.

In an optional aspect, rotating the dispensing element may be accomplished by exerting a force on a rim at least partially delimiting the outlet orifice.

Besides the structural arrangements and procedural aspects described above, there could be a number of other arrangements, such as those explained hereinafter. It is to be understood that both the foregoing description and the following description are exemplary.

The accompanying drawings are incorporated in and constitute a part of this specification. The drawings illustrate exemplary embodiments of the inventions. In the drawings.

Reference will now be made to exemplary embodiments of the invention, examples of which are shown in the drawings. Whenever possible, the same reference numerals are used to refer to the same or like parts.

Figure 1A:
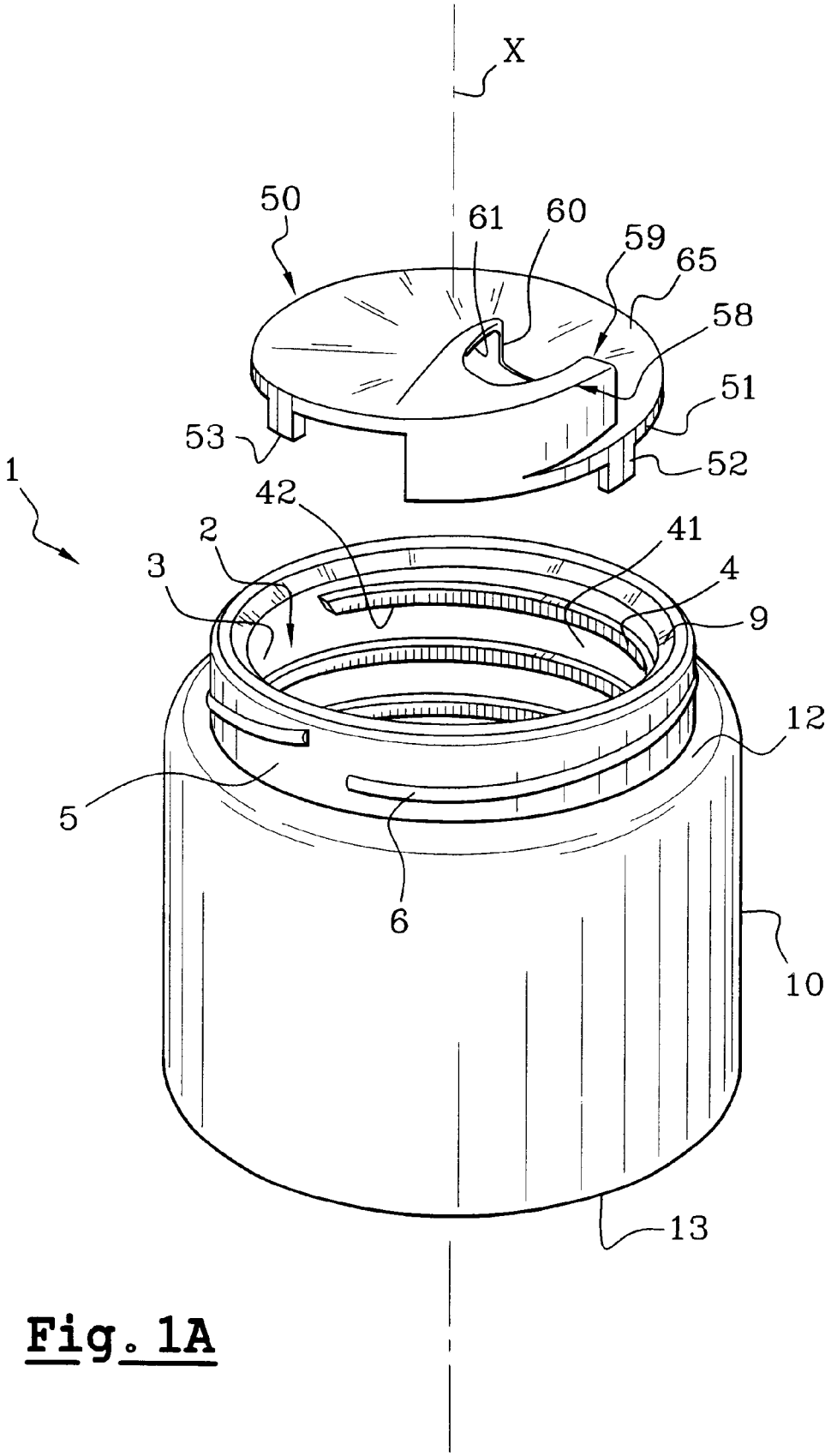
FIGS. 1A–1B illustrate a first exemplary embodiment of the dispensing device according to the invention.
Figure 1B:
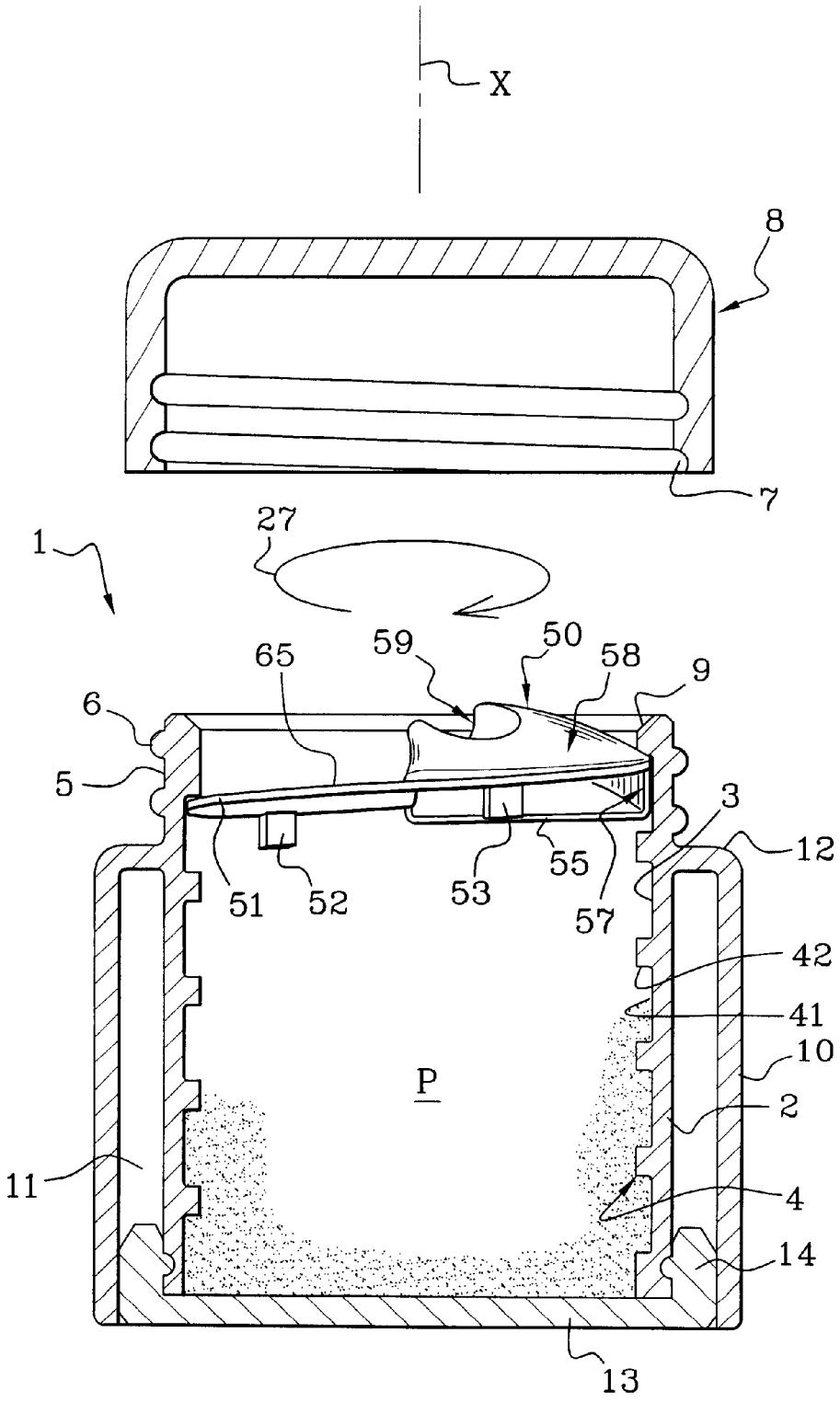

The dispensing device 1 depicted in FIGS. 1A–1B has a container with a cylindrical overall shape and an axis X. The dispensing device 1 comprises an interior wall 2, having an internal surface 3 forming a reservoir for product P and being provided with a screw thread 4 extending more or less over the entire height of the dispensing device. The exterior surface 5 of the wall 2 comprises, near its upper edge, a screw thread 6 capable of collaborating with a corresponding screw thread 7 provided on a lid 8 capable of removably covering an opening 9 formed by the free edge of the wall 2.

The dispensing device 1 also comprises an exterior wall 10 defining, with the interior wall 2, an annular space 11. The exterior wall 10 extends more or less as far as the lower edge of the wall 2, and is connected at its upper part to the wall 2 via a transverse portion 12, forming a shoulder for the dispensing device 1.

At its end opposite to the opening 9, the dispensing device is closed by an added-on bottom 13 having a rim 14 snap-fastened into the annular space formed between the interior wall 2 and the exterior wall 10. Alternatively, the bottom 13 may be obtained by molding directly with the dispensing device.

Arranged removably in the dispensing device, above the free surface of the product P, is a dispensing element 50 which will now be described in detail with reference to FIGS. 4–7.

The dispensing element 50 is of circular cross section, more or less identical to the interior cross section of the dispensing device 1 for which it is intended. The element 50 is shaped in the manner of a helicoid with a peripheral edge 51 forming a helical screw thread extending over approximately 360°, and being capable of collaborating with the screw thread 4 formed on the interior surface 3 of the dispensing device 1.

The height of the recessed portions 41 of the screw thread 4 is greater than the thickness of the helicoid formed by the dispensing element 50. Typically, the thickness of the helicoid is of the order of about 1 to about 2 mm. The height of the recessed portions 41 on the screw thread 4 may be of the order of about 5 to about 10 mm. On the side facing towards the bottom 13, the dispensing element 50 has a number of lateral rim portions 52, 53, 54 uniformly spaced around the entire periphery of the disc, and having a height such that the dispensing element 50 is forced against the upper surface 42 of the recessed portions 41 of the screw thread 4 produced on the internal surface 3 of the dispensing device.

The dispensing element 50 comprises a first edge 55 extending radially from the center of the dispensing element 50 to its periphery. The combination of the first edge 55 and the corresponding portion 56 of the helicoid situated at 360° delimits an inlet orifice 57 of oblong shape. This corresponding portion 56 forms an upper edge of the inlet orifice 57. The inlet orifice 57 extends in a plane passing more or less through the central axis of the element 50. The inlet orifice 57 appears more clearly in the view from beneath depicted in FIG. 6 of the drawing.

Beyond the portion 56 of the helicoid, the dispensing element 50 is continued by a passage 58 shaped in the manner of a "chute", and extending over an angle of about 45°. The peripheral edge of the passage 58 has a radius of curvature smaller than the radius of curvature of the helical part of the element 50, so that the outlet orifice 59 formed at the end of the passage 58 is some distance from the helical edge 51.

The outlet orifice 59 comprises a first portion 60 extending in a plane more or less parallel to the plane formed by the inlet orifice 57, over a radial width that more or less corresponds to the width of a finger. For example, this width could be approximately 20 mm or less. The outlet orifice 59 comprises a second portion 61 extending in a plane transversal to the plane of the inlet orifice 57. The radial width of the portion 61 diminishes gradually in the direction away from the portion 60.

The portion 60 of the outlet orifice is partly delimited by a lower edge 62 situated about 5 mm, for example, from the surface 65 of the helicoid and formed by a rim 64. The passage 58 has a bottom 63 extending from the edge 55 of the helicoid to the lower edge 62 of the outlet orifice 59. The bottom 63 has a slope greater than the slope formed by the dispensing element 50 on its helical part. Because of this configuration, at least part of the outlet orifice 59 is above the uppermost point of the inlet orifice 57. As a result of this, a configuration such as this allows the outlet orifice 59 to open some distance away from the surface 65 of the helicoid.

Figure 2:
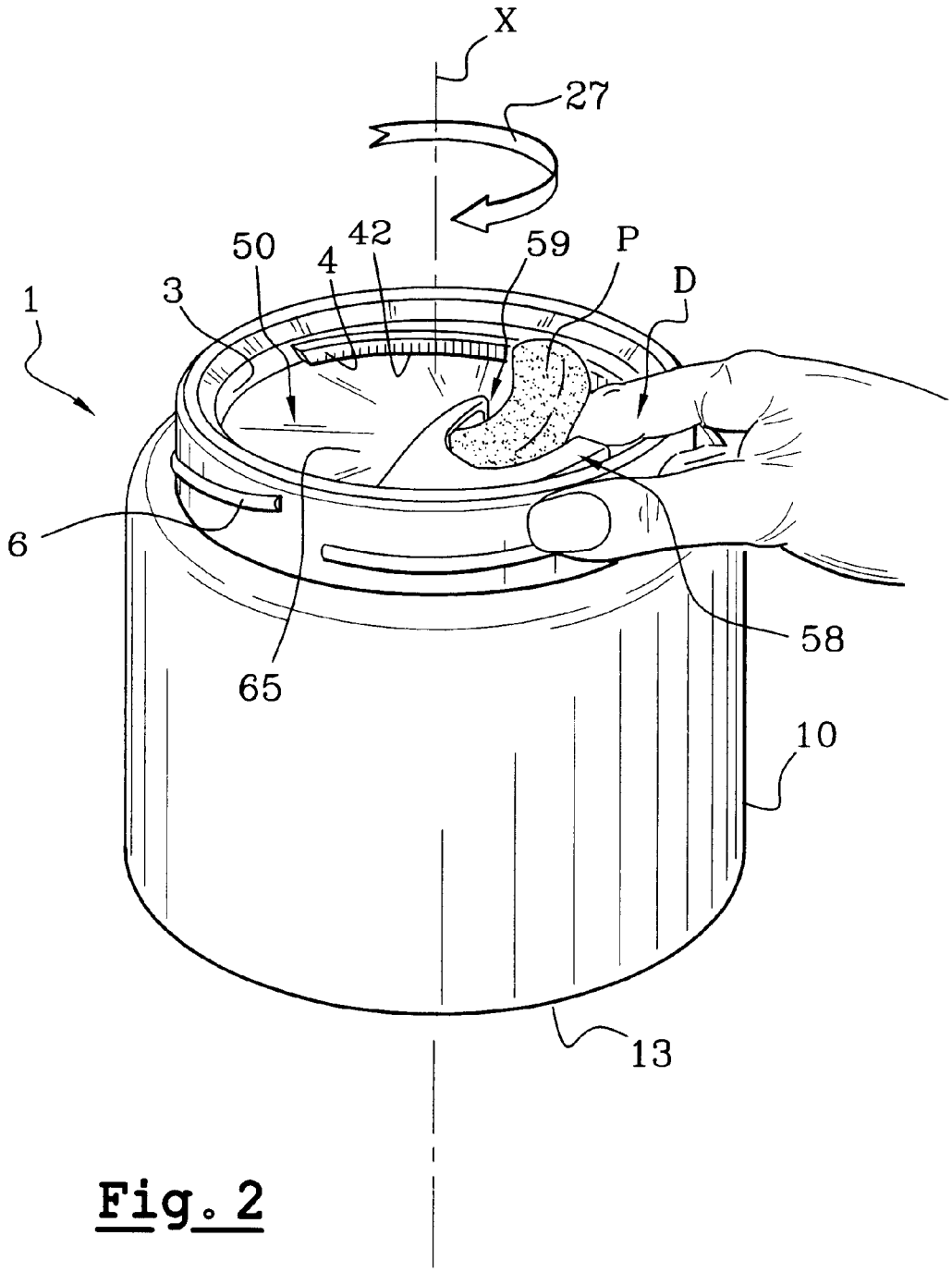
FIG. 2 illustrates the use of the dispensing device depicted in FIGS. 1A and 1B.

Use of the dispensing device according to this first exemplary embodiment is more readily apparent in FIGS. 1B and 2. As shown in these figures, the dispensing element 50 is positioned on the free surface of the product P. The peripheral edge 51 of the dispensing element 50 is engaged with the screw thread 4 of the interior surface 3 of the dispensing device. To dispense a dose of product, the user places her finger (D) in engagement with the rim 64, so that the fingernail faces towards the bottom 13 of the dispensing device. She then turns the dispensing element 50 in the direction illustrated by the arrow 27, for example. As she does this, the dispensing element 50 progresses towards the bottom 13 of the dispensing device. The product P is "sliced" by the radial edge 55 of the helicoid 50, and travels up along the passage 58 and passes via the outlet orifice 59 directly onto the finger (D) that is turning the element 50. Once the desired amount has been dispensed, the user removes her finger, on which the product has been deposited, and applies the product in the conventional way to the desired area.

Thereafter, the exterior surface 65 of the dispensing element 50 is clean. The dispensing device is therefore ready to be used again.

Figure 3A:
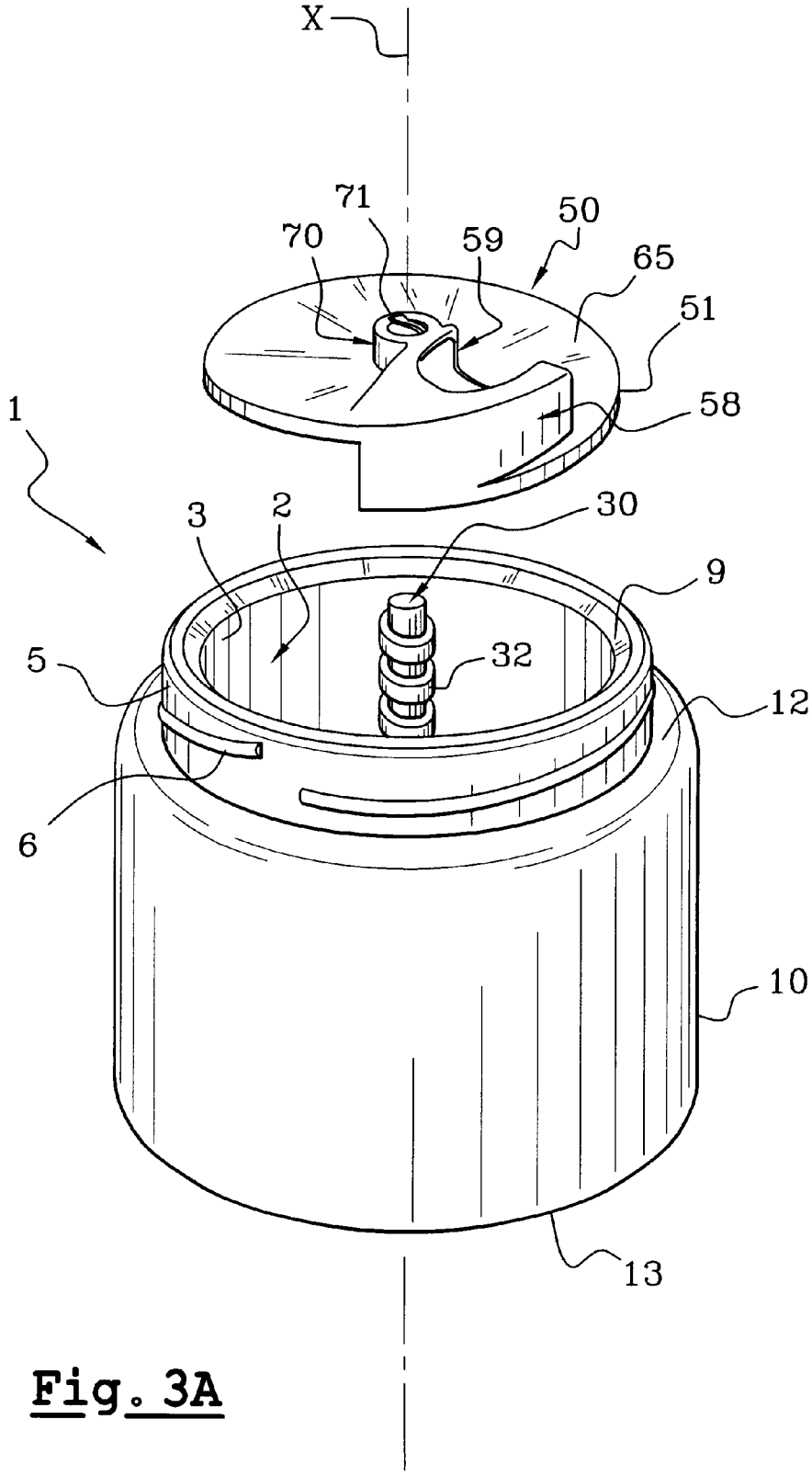
FIGS. 3A–3B illustrate a second exemplary embodiment of the dispensing device according to the invention.
Figure 3B:
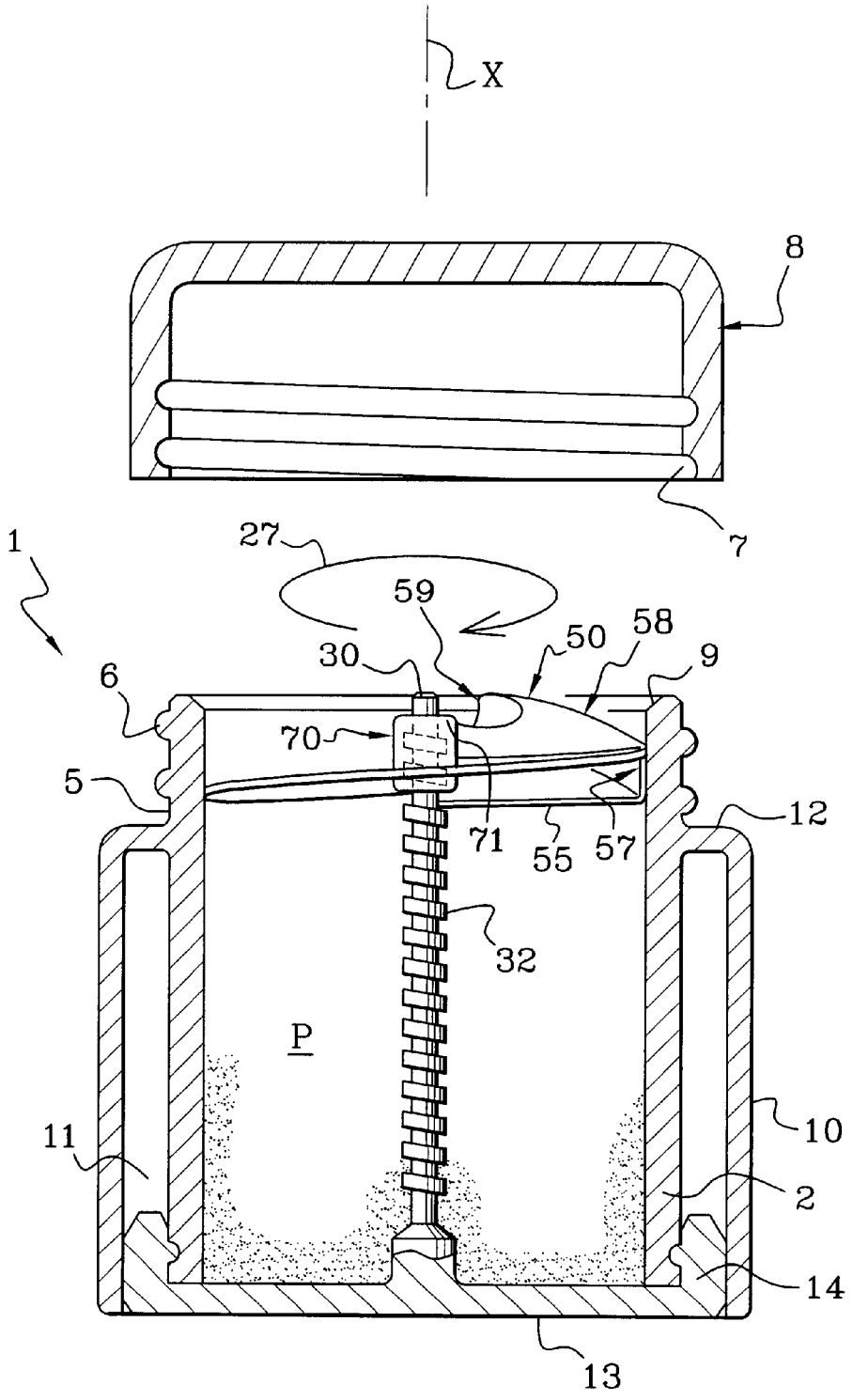
Figure 4:
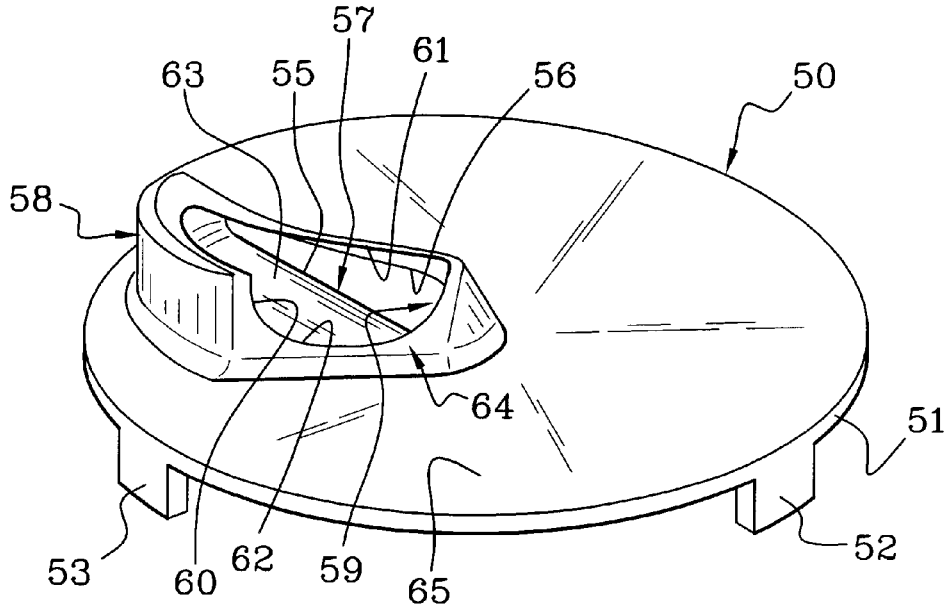
FIGS. 4–7 are views of an exemplary embodiment of a dispensing element for use with the device of FIGS. 1A–1B.
Figure 5:
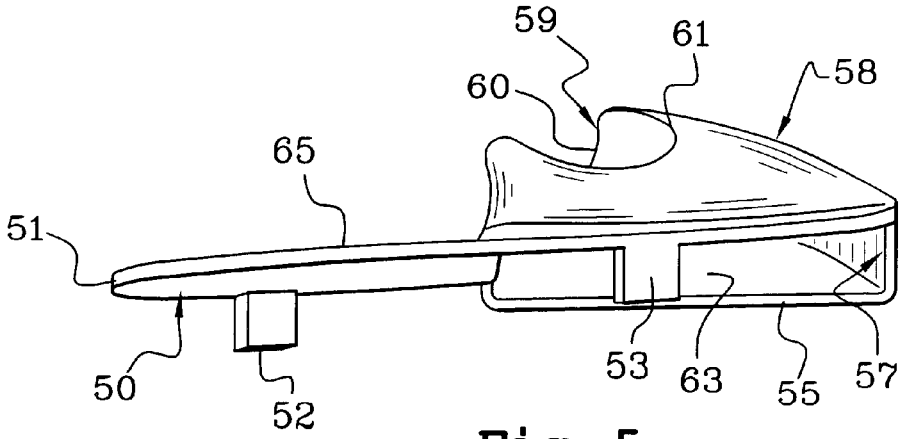
Figure 6:
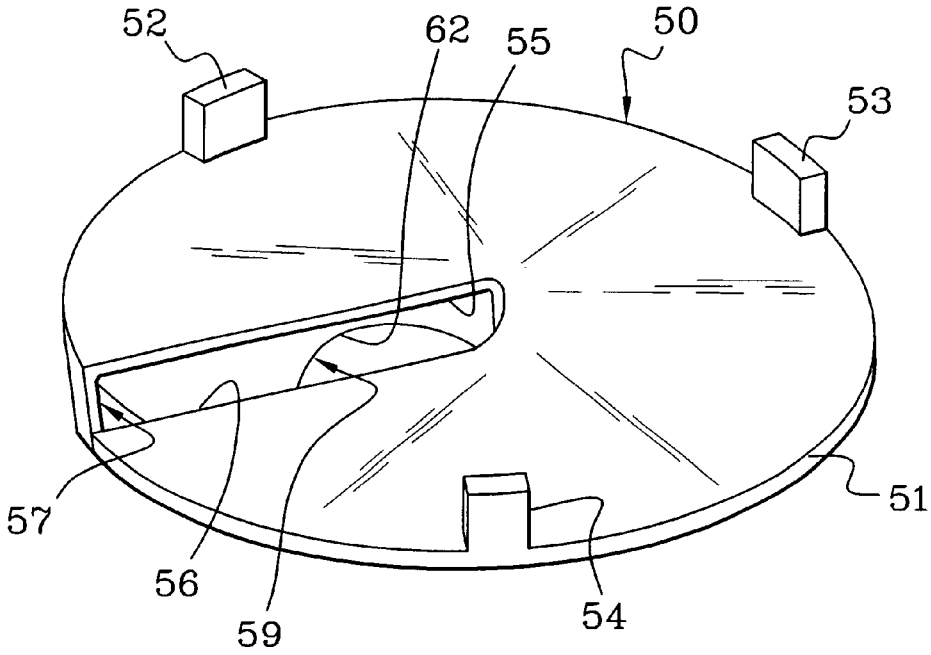
Figure 7:
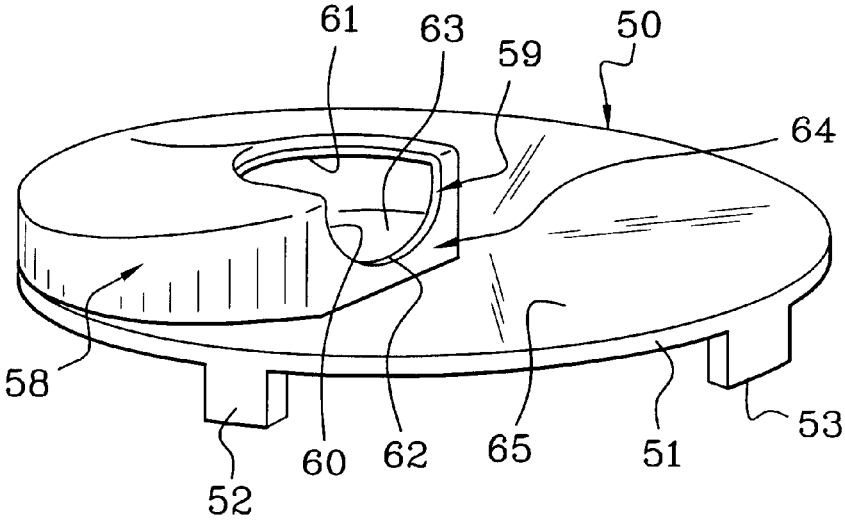

The exemplary embodiment illustrated in FIGS. 3A and 3B differs from the previous embodiment in that the internal surface of the dispensing device 2 has no screw thread and is more or less smooth.

The bottom 13 of the dispensing device 1 carries a threaded rod 30 projecting axially into the dispensing device and extending more or less to an extent near the opening 9 of the dispensing device. The threaded rod 30 can be obtained by molding with the bottom 13 or may be screwed onto bottom 13.

The dispensing element 50 has a central passage 70, having an internal surface 71 provided with a screw thread capable of collaborating with the screw thread 32 of the rod 30. Otherwise, the dispensing element 50 is essentially identical to the one described with reference to FIGS. 4–7.

The functioning of the dispensing device according to this embodiment is similar to that of the previous embodiment, in that the progression of the dispensing element 50 towards the bottom 13 of the dispensing device is by virtue of the collaboration of the screw thread 32 of the rod 30 with the screw thread of the central passage 70. Because of the high viscosity of the product, sealing at the periphery of the dispensing element 50 is not a problem.

It will be apparent to those skilled in the art that various modifications and variations can be made to the structure and methodology described herein. Thus, it should be understood that the invention is not limited to the embodiments and examples discussed in the specification. Rather, the present invention is intended to cover modifications and variations.

What is claimed is:

1. A dispensing device comprising:

a container defining a reservoir configured to contain a product, the container having a bottom, an opening, and an axis;

a dispensing element configured to be in contact with product in the reservoir, the dispensing element defining a passage comprising at least one inlet orifice extending in a plane not perpendicular to the axis of the container and at least one outlet orifice spaced at least partially from the inlet orifice and extending at least partially above an upper edge of the inlet orifice; and a rim having an edge at least partly delimiting the outlet orifice, wherein the dispensing element is configured to rotate relative to the container so as to cause the product to be delivered through the outlet orifice, and wherein the rim is configured to allow a user to rotate the dispensing element inside the container.

2. The dispensing device of claim 1, comprising means for causing a reduction in an axial distance between the dispensing element and the bottom when the dispensing element is rotated relative to the container.

3. The dispensing device of claim 1, wherein a height of the rim is from about 1 mm to about 15 mm.

4. The dispensing device of claim 1, wherein a height of the rim is from about 2 mm to about 5 mm.

5. The dispensing device of claim 1, wherein the rim is configured to be engaged by an applicator member to rotate the dispensing element and dispense product onto the applicator member.

6. The dispensing device of claim 5, wherein the applicator member is at least one finger of a user.

7. The dispensing device of claim 1, wherein at least a part of the outlet orifice extends in a plane that is not parallel to a plane defined by the inlet orifice.

8. The dispensing device of claim 7, wherein a part of the outlet orifice extends in a plane substantially parallel to the plane defined by the inlet orifice.

9. The dispensing device of claim 1, wherein a cross-sectional area of the outlet orifice is as least as large as a cross-sectional area of the inlet orifice.

10. The dispensing device of claim 1, wherein a mean radial width of the inlet orifice is greater than a mean radial width of the outlet orifice.

11. The dispensing device of claim 1, wherein a maximum radial width of the outlet orifice is not larger than about 20 mm.

12. The dispensing device of claim 1, wherein the dispensing element has a transverse cross-section having substantially the same shape as a transverse cross-section of the reservoir, and wherein the inlet orifice extends radially from a first end near a center of the dispensing element to a second end near a periphery of the dispensing element.

13. A dispensing device comprising:

a container defining a reservoir configured to contain a product, the container having a bottom, an opening, and an axis; and a dispensing element configured to be in contact with product in the reservoir, the dispensing element defining a passage comprising at least one inlet orifice extending in a plane not perpendicular to the axis of the container and at least one outlet orifice spaced at least partially from the inlet orifice and extending at least partially above an upper edge of the inlet orifice, wherein the dispensing element is configured to rotate relative to the container so as to cause the product to be delivered through the outlet orifice, and wherein the dispensing element has a circular cross-section and at least partially forms a helical portion.

14. The dispensing device of claim 13, wherein the dispensing element forms the helical portion over an angle of approximately 360°.

15. The dispensing device of claim 13, wherein the passage has a bottom extending between the inlet orifice and the outlet orifice, and wherein a mean slope of the bottom is greater than a mean slope of the helical portion.

16. The dispensing device of claim 13, wherein a peripheral edge of the dispensing element forms a helical screw thread configured to be engaged with a corresponding screw thread formed on an interior surface the container.

17. The dispensing device of claim 16, wherein the container comprises an added insert element and wherein the corresponding screw thread is formed the insert element.

18. The dispensing device of claim 16, wherein the corresponding screw thread defines recessed portions having an axial height greater than a thickness of the peripheral edge.

19. The dispensing device of claim 18, further comprising a lateral rim configured to maintain engagement between the dispensing element and an upper surface of the recessed portions.

20. The dispensing device of claim 1, further comprising a rod fixedly mounted inside the container and extending from the bottom to near the opening;

wherein the dispensing element defines a central passage having an interior wall, and wherein the interior wall has a screw threading configured to be engaged with a corresponding screw threading provided on an exterior surface of the rod.

21. The dispensing device of claim 1, wherein a plane defined by the inlet orifice passes substantially through the axis of the container.

22. The dispensing device of claim 1, wherein the bottom of the container has substantially the same profile as an under side of the dispensing element to minimize a gap between the under side of the dispensing element and the bottom of the container when the dispensing element is at the bottom of the container.

23. The dispensing device of claim 1, wherein the bottom is an added-on bottom.

24. The dispensing device of claim 1, wherein the dispensing element is removably mounted inside the container.

25. The dispensing device of claim 1, further comprising a removable closure element configured to close off the opening of the container.

26. The dispensing device of claim 1, wherein the container and dispensing element are made from a material chosen from a thermoplastic and a material from the styrene family.

27. The dispensing device of claim 26, wherein the thermoplastic is chosen from a polyethylene, a polypropylene, a polyethylene terephthalate, and a polyvinyl chloride.

28. The dispensing device of claim 1, further comprising a product contained in the reservoir, wherein the product has a viscous consistency.

29. The dispensing device of claim 28, wherein the product is chosen from a cream, a gel, an ointment, and a balm.

30. The dispensing device of claim 28, wherein the product is chosen from a cosmetic product and a medical product.

31. A method of dispensing, comprising:

providing the dispensing device of claim 1 containing a product of viscous consistency;

rotating the dispensing element relative to the container to thereby dispense product through the outlet orifice; and applying the product to a surface.

32. The method of claim 31, wherein rotating the dispensing element is accomplished by exerting a force on a rim at least partially delimiting the outlet orifice.

33. The method of claim 31, passing the product directly from the outlet orifice to an applicator member.

34. The method of claim 33, wherein the applicator member comprises at least one finger.

35. The method of claim 33, wherein the product is chosen from a cosmetic product and a medical product, and wherein the surface comprises an external body portion.

36. A dispensing device comprising:

a container defining a reservoir configured to contain a product, the container having a bottom, an opening, and an axis; and a dispensing element configured to be in contact with product in the reservoir, the dispensing element defining a passage comprising at least one inlet orifice extending in a plane not perpendicular to the axis of the container and at least one outlet orifice spaced at least partially from the inlet orifice and extending at least partially above an upper edge of the inlet orifice, wherein the dispensing element is configured to rotate relative to the container so as to cause the product to be delivered through the outlet orifice, and wherein a cross section of the outlet orifice is of a different shape than a cross section of the inlet orifice.

37. A dispensing device comprising:

a container defining a reservoir configured to contain a product, the container having a bottom and an opening;

a dispensing element configured to be in contact with product in the reservoir, the dispensing element defining a passage comprising at least one inlet orifice and at least one outlet orifice spaced from the inlet orifice; and a rim having an edge at least partly delimiting the outlet orifice, wherein the dispensing element is configured to rotate relative to the container about an axis of rotation so as to cause the product to be delivered through the outlet orifice, wherein the rim is configured to allow a user to rotate the dispensing element inside the container, and wherein the inlet orifice and the outlet orifice are positioned at differing radial positions with respect to the axis of rotation.

38. The dispensing device of claim 37, wherein the outlet orifice extends at least partially above an upper edge of the inlet orifice.

39. The dispensing device of claim 37, wherein the inlet orifice extends in a plane not perpendicular to the axis of rotation.

40. The dispensing device of claim 37, comprising means for causing a reduction in an axial distance between the dispensing element and the bottom when the dispensing element is rotated relative to the container.

41. The dispensing device of claim 37, wherein the rim is configured to be engaged by an applicator member to rotate the dispensing element and dispense product onto the applicator member.

42. The dispensing device of claim 37, wherein at least a part of the outlet orifice extends in a plane that is not parallel to a plane defined by the inlet orifice.

43. The dispensing device of claim 42, wherein a part of the outlet orifice extends in a plane substantially parallel to the plane defined by the inlet orifice.

44. The dispensing device of claim 37, wherein a cross-sectional area of the outlet orifice is as least as large as a cross-sectional area of the inlet orifice.

45. A dispensing device comprising:

a container defining a reservoir configured to contain a product, the container having a bottom and an opening; and a dispensing element configured to be in contact with product in the reservoir, the dispensing element defining a passage comprising at least one inlet orifice and at least one outlet orifice spaced from the inlet orifice, wherein the dispensing element is configured to rotate relative to the container about an axis of rotation so as to cause the product to be delivered through the outlet orifice, wherein a cross section of the outlet orifice is of a different shape than a cross section of the inlet orifice, and wherein the inlet orifice and the outlet orifice are positioned at differing radial positions with respect to the axis of rotation.

46. The dispensing device of claim 37, wherein a mean radial width of the inlet orifice is greater than a mean radial width of the outlet orifice.

47. The dispensing device of claim 37, wherein the dispensing element has a transverse cross-section having substantially the same shape as a transverse cross-section of the reservoir, and wherein the inlet orifice extends radially from a first end near a center of the dispensing element to a second end near a periphery of the dispensing element.

48. The dispensing device of claim 37, further comprising a rod fixedly mounted inside the container and extending from the bottom to near the opening;

wherein the dispensing element defines a central passage having an interior wall, and wherein the interior wall has a screw threading configured to be engaged with a corresponding screw threading provided on an exterior surface of the rod.

49. The dispensing device of claim 37, wherein a plane defined by the inlet orifice passes substantially through the axis of the container.

50. The dispensing device of claim 37, wherein the bottom of the container has substantially the same profile as an under side of the dispensing element to minimize a gap between the under side of the dispensing element and the bottom of the container when the dispensing element is at the bottom of the container.

51. The dispensing device of claim 37, further comprising a product contained in the reservoir, wherein the product has a viscous consistency.

52. The dispensing device of claim 51, wherein the product is chosen from a cream, a gel, an ointment, and a balm.

53. The dispensing device of claim 51, wherein the product is chosen from a cosmetic product and a medical product.

54. A dispensing device comprising:

a container defining a reservoir configured to contain a product, the container having a bottom and an opening; and a dispensing element configured to be in contact with product in the reservoir, the dispensing element defining a passage comprising at least one inlet orifice and at least one outlet orifice spaced from the inlet orifice, wherein the dispensing element is configured to rotate relative to the container about an axis of rotation so as to cause the product to be delivered through the outlet orifice, wherein the inlet orifice and the outlet orifice are positioned at differing radial positions with respect to the axis of rotation, and wherein the dispensing element has a circular cross-section and at least partially forms a helical portion.

55. The dispensing device of claim 54, wherein the dispensing element forms the helical portion over an angle of approximately 360°.

56. The dispensing device of claim 54, wherein the passage has a bottom extending between the inlet orifice and the outlet orifice, and wherein a mean slope of the bottom is greater than a mean slope of the helical portion.

57. The dispensing device of claim 54, wherein a peripheral edge of the dispensing element forms a helical screw thread configured to be engaged with a corresponding screw thread formed on an interior surface the container.

58. A dispensing device comprising:

a container defining a reservoir configured to contain a product, the container having a bottom, an opening, and an axis, wherein an interior portion of the container includes screw threading;

a dispensing element configured to be in contact with product in the reservoir, the dispensing element defining a passage comprising at least one inlet orifice extending in a plane not perpendicular to the axis and at least one outlet orifice spaced at least partially from the inlet orifice; and a rim having an edge at least partly delimiting the outlet orifice, wherein the dispensing element is configured to rotate relative to the container so as to cause the product to be delivered through the outlet orifice, wherein the rim is configured to allow a user to rotate the dispensing element inside the container, and wherein a peripheral edge of the dispensing element forms a portion configured to be engaged with the screw threading formed on the interior portion of the container.

59. The dispensing device of claim 58, wherein the peripheral edge of the dispensing element is in the form of a helical screw threading.

60. A dispensing device comprising:

a container defining a reservoir configured to contain a product;

the container having a bottom, an opening, an axis, and a rod mounted inside the container and extending from the bottom to near the opening, wherein an exterior surface of the rod includes screw threading;

a dispensing element configured to be in contact with product in the reservoir, the dispensing element defining a passage comprising at least one inlet orifice extending in a plane not perpendicular to the axis and at least one outlet orifice spaced at least partially from the inlet orifice, the dispensing element further defining a central passage having an interior surface including screw threading configured to be engaged with the screw threading provided on the exterior surface of the rod; and a rim having an edge at least partly delimiting the outlet orifice, wherein the dispensing element is configured to rotate relative to the container so as to cause the product to be delivered through the outlet orifice, and wherein the rim is configured to allow a user to rotate the dispensing element inside the container.

61. A dispensing device comprising:

a container defining a reservoir configured to contain a product, the container having a bottom and an opening;

a dispensing element configured to be in contact with product in the reservoir, the dispensing element defining a passage comprising at least one inlet orifice and at least one outlet orifice spaced from the inlet orifice; and a rim having an edge at least partly delimiting the outlet orifice, wherein the dispensing element is configured to rotate relative to the container about an axis of rotation so as to cause the product to be delivered through the outlet orifice, wherein the rim is configured to allow a user to rotate the dispensing element inside the container, and wherein the passage at least partially encircles the axis of rotation.

* * * * *

UNITED STATES PATENT AND TRADEMARK OFFICE

CERTIFICATE OF CORRECTION

PATENT NO. : 6,655,557 B2 
DATED : December 2, 2003
INVENTOR(S) : Guilhem Rousselet et al.

It is certified that error appears in the above-identified patent and that said Letters Patent is hereby corrected as shown below:

Column 10,
Line 10, “is as least” should read -- is at least --.
Line 51, “surface the” should read -- surface of the --.
Line 54, “formed the” should read -- formed on the --.

Column 12,
Line 44, “is as least” should read -- is at least --.

Column 13,
Line 59, “surface the” should read -- surface of the --.

Signed and Sealed this

Third Day of February, 2004

JON W. DUDAS
*Acting Director of the United States Patent and Trademark Office*